US008490718B2

(12) United States Patent
Lunde

(10) Patent No.: US 8,490,718 B2
(45) Date of Patent: Jul. 23, 2013

(54) PORTABLE PIPE STORAGE DEVICE

(75) Inventor: Ola Lunde, Hafrsfjord (NO)

(73) Assignee: Seabed Rig AS (NO)

( * ) Notice: Subject to any disclaimer, the term of this patent is extended or adjusted under 35 U.S.C. 154(b) by 1 day.

(21) Appl. No.: 13/387,990

(22) PCT Filed: Jul. 28, 2010

(86) PCT No.: PCT/NO2010/000292
§ 371 (c)(1),
(2), (4) Date: Mar. 23, 2012

(87) PCT Pub. No.: WO2011/014074
PCT Pub. Date: Feb. 3, 2011

(65) Prior Publication Data

US 2012/0175326 A1 Jul. 12, 2012

(30) Foreign Application Priority Data

Jul. 29, 2009 (NO) ..... 20092780

(51) Int. Cl.
*E21B 19/14* (2006.01)

(52) U.S. Cl.
USPC ..... 175/52; 211/70.4

(58) Field of Classification Search
USPC ..... 211/70.4, 60.1; 175/52, 85; 414/22.66
See application file for complete search history.

(56) References Cited

U.S. PATENT DOCUMENTS

| | | | | | |
|---|---|---|---|---|---|
| 1,494,324 | A * | 5/1924 | Owen | 211/70.4 |
| 1,718,395 | A * | 6/1929 | Webb et al. | 211/70.4 |
| 1,804,962 | A * | 5/1931 | Thorpe | 211/70 |
| 1,947,553 | A * | 2/1934 | Johnston | 211/70.4 |
| 1,971,609 | A * | 8/1934 | Harrah | 211/70.4 |
| 2,738,076 | A * | 3/1956 | Porter | 211/70.4 |
| 3,146,889 | A * | 9/1964 | Franco | 211/68 |
| 3,157,286 | A | 11/1964 | Gyongyosi | |
| 3,913,754 | A | 10/1975 | Swartz et al. | |
| 4,725,179 | A * | 2/1988 | Woolslayer et al. | 414/22.65 |
| 4,760,985 | A * | 8/1988 | Stewart et al. | 248/176.1 |
| 6,179,065 | B1 * | 1/2001 | Payne et al. | 175/24 |
| 6,845,825 | B2 * | 1/2005 | Bischel et al. | 175/24 |
| 6,962,476 | B2 * | 11/2005 | Trpkovski | 414/745.1 |
| 2011/0005162 | A1 * | 1/2011 | Roodenburg et al. | 52/651.05 |

FOREIGN PATENT DOCUMENTS

| | | | |
|---|---|---|---|
| AU | 716459 | B2 | 2/2000 |
| DE | 3608511 | A1 | 9/1987 |
| GB | 2346840 | A | 8/2000 |
| JP | 2000351447 | A | 12/2000 |
| WO | 2004018826 | A1 | 3/2004 |

OTHER PUBLICATIONS

Written Opinion issued in connection with PCT/NO2010/000292.

* cited by examiner

*Primary Examiner* — Korie H Chan
(74) *Attorney, Agent, or Firm* — Akerman Senterfitt

(57) ABSTRACT

A portable pipe storage device (1) for use in a drilling rig (10), the pipe storage device (1) including a frame structure (2) with long sides (4) and end portions (6, 8) and the pipe storage device (1) being arranged to hold two or more pipes (14), pipes (14) stored in the pipe storage device (1) having their longitudinal axes (16) in a standing direction when the pipe storage device (1) is in its position of use in the drilling rig (10).

6 Claims, 7 Drawing Sheets

III-III

PORTABLE PIPE STORAGE DEVICE

This application is a national phase of PCT/NO2010/000292, filed Jul. 28, 2010, and claims priority to NO 2009 2780, filed Jul. 29, 2009, the entire contents of both of which are hereby incorporated by reference.

This invention relates to a portable pipe storage device. More particularly, it relates to a portable pipe storage device for use in a drilling rig, the pipe storage device including a frame structure with long sides and end portions, the pipe storage device being arranged to hold two or more pipes.

As is known, during the drilling of boreholes in the ground, pipes are assembled into a drill string. Thus, there is a need for a relatively large number of pipes which often have to be carried in one by one from a lying position outside a drilling rig to the drilling centre of the drilling rig.

For example, when drilling tools are being replaced, the drill string has to be pulled up and disassembled. The pipes are typically stored intermediately in so-called fingerboards in the drilling rig, as far as space allows it.

The weight of intermediately stored pipes can be considerable and entails problems with load-carrying capacity and, in vessel-based drilling rigs, also stability problems.

Pipes for which there is no room in the fingerboard must be transported out of the drilling rig and stored in a horizontal position, which may cause extra consumption of time.

When subsea rigs are used, it is inexpedient to transport pipes one by one from the surface. Known solutions, like cartridges resembling revolver magazines are relative complicated with respect to locking pipes during the removal and insertion of pipes from/into the cartridge.

The invention has for its object to remedy or reduce at least one of the drawbacks of the prior art.

The object is achieved according to the invention through the features which are specified in the description below and in the claims that follow.

A portable pipe storage device for use in a drilling rig is provided, the pipe storage device comprising a frame structure with long sides and end portions, the pipe storage device being arranged to hold two or more pipes, and the pipe storage device being characterized by pipes stored in the pipe storage device having their longitudinal axes in a standing, approximately vertical direction when the pipe storage device is in its position of use in the drilling rig.

The pipe storage device has several positions of use. During transport to and from the drilling rig, the pipe storage device and thereby the pipes in the storage device are most practically in a horizontal position, the pipes thereby being above each other or lying side by side. In its position of use, when the pipe storage device is in use in the drilling rig, the pipe storage device is in a standing position.

In the position of use in the drilling rig, the pipes may be arranged in one or more layers arranged laterally.

The pipe storage device may be provided with an opening in one of its long sides, the opening being arranged to form a displacement opening for the removal and insertion of pipes from/into the pipe storage device.

During transport to and from the drilling rig, this opening is, with advantage, directed upwards, whereas when the pipe storage device is placed in the drilling rig, the opening is directed towards a pipe manipulator of a kind known per se, which is arranged to move pipes between the pipe storage device and the drilling centre of the drilling rig.

The length of the opening may be smaller than the pipe length. Pipes are thereby prevented from unintentionally falling out of the pipe storage device.

At its lower portion in its position of use, the pipe storage device may be provided with a first pipe support. With advantage, the first pipe support may be formed with a recess which includes an elastic material to protect the external threads of the pipe.

At its upper portion in its position of use, the pipe storage device may be provided with a second pipe support. With advantage, the second pipe support may include side supports which may be arranged to keep the pipes in the pipe storage device in line during the insertion of pipes into the pipe storage device. Further, elastic position holders may be arranged, which are arranged to prevent the standing pipes in the pipe storage device from leaning over towards the opening.

The pipe storage device may be provided with a displaceable stop which is arranged to prevent pipes which are in the pipe storage device from moving in an axial direction in the pipe storage device.

When the stop is in its active position, the pipes in the pipe storage device are prevented from being moved out of the first pipe support.

The stop may be spring-loaded towards its active position, it being arranged to be moved, by means of an actuator or manually, into its passive position in which it is disengaged from the pipes in the pipe storage device.

The pipe storage device according to the invention enables simultaneous transport of several pipes to and from a drilling rig, as the pipe storage device is adapted for the uncomplicated removal and insertion of single pipes.

In what follows is described an example of a preferred embodiment which is visualized in the accompanying drawings, in which.

Figure 1:
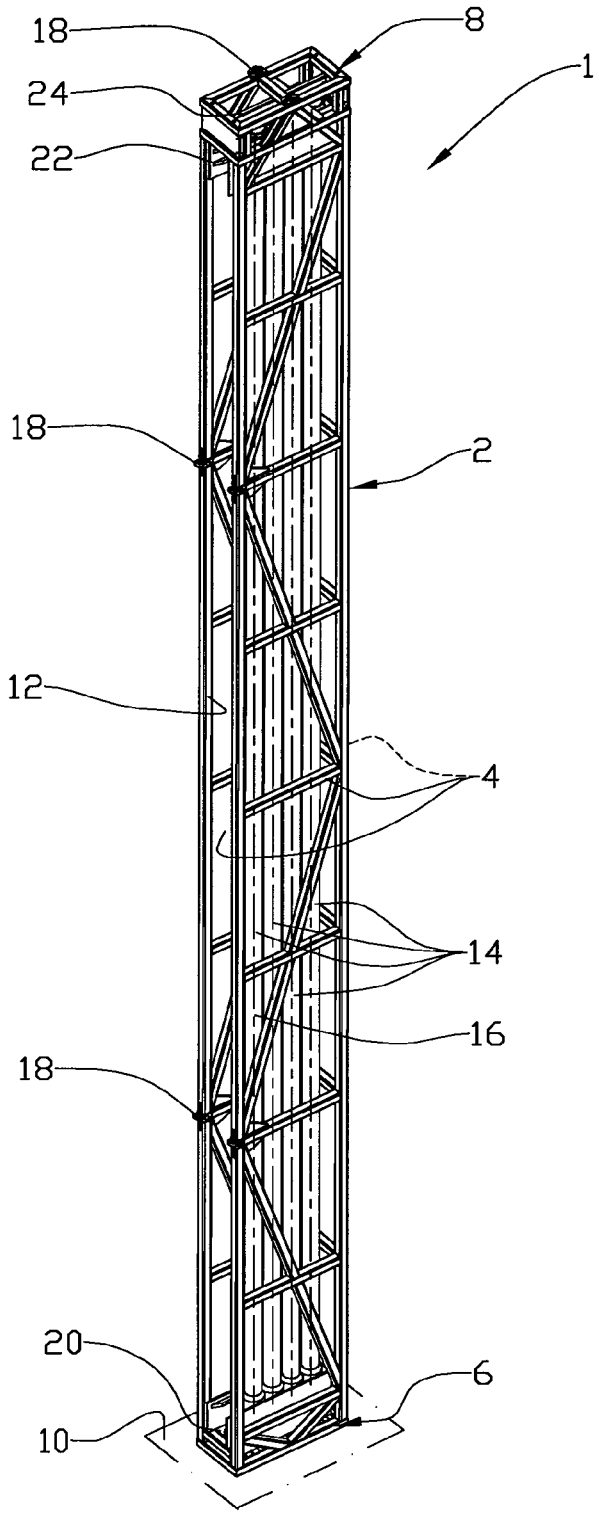
FIG. 1 shows, in perspective, a pipe storage device in accordance with the invention in its active position in a drilling rig.

In the drawings, the reference numeral 1 indicates a box-like pipe storage device which includes a frame structure 2. The frame structure 2 is formed with long sides 4, a first end portion 6 and a second end portion 8.

In the position of use on a drilling rig 10, the first end portion 6 constitutes a lower end portion, whereas the second end portion 8 constitutes an upper end portion.

An opening 12, which is shorter than the pipes 14 that are in the pipe storage device 1, is arranged in one of the long sides 4 of the frame structure 2. The longitudinal axes 16 of the pipes 14 are parallel to the longitudinal direction of the pipe storage device 1.

The frame structure 2 is provided with lifting lugs 18 to enable lifting in both its vertical and its horizontal position.

At its first end portion 6, the frame structure 2 is provided with a first pipe support 20, whereas the second end portion 8 is provided with a second pipe support 22 and a stop 24.

Figure 2:
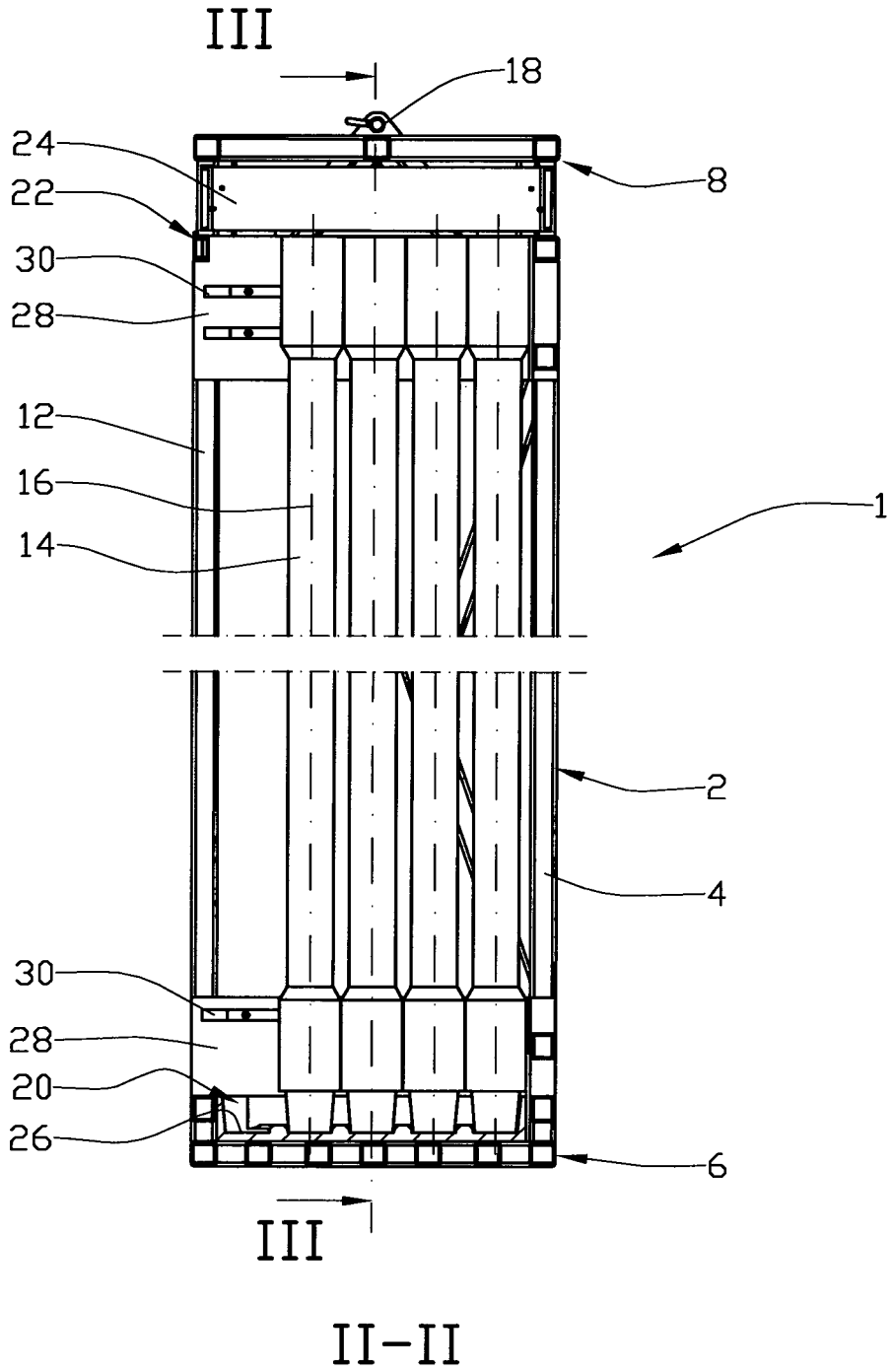
FIG. 2 shows, on a larger scale, a vertical section III-III of the pipe storage device of FIG. 3.

The first pipe support 20 is formed with a recess 26 for each pipe 14, the recesses including an elastic material, see FIG. 2.

Figure 7:
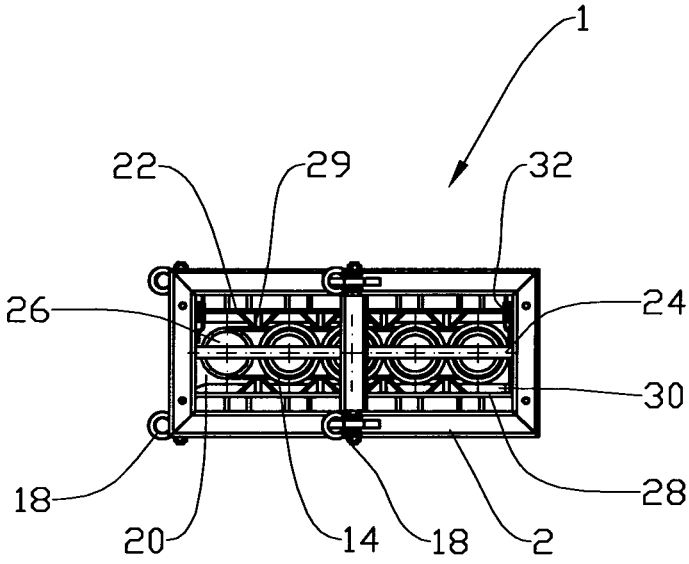
FIG. 7 shows a plan view of the pipe storage device.

Both the first pipe support 20 and the second pipe support 22 are provided with lateral guide plates 28 which are arranged to hold the pipes 14 in position sideways. Further, guiding strips 30 are arranged, which are preferably formed of an elastic material. From the lateral guide plates 28 of the second pipe support 22, bulbs 29 project in between the pipes 14, see FIG. 7. The distance between the bulbs 29 is sufficient for pipes 14 to be both lifted and rotated somewhat while they are between the bulbs 29. Because of the bulbs 29, the pipes 14 are prevented from unintentionally tilting sideways in the direction of insertion and removal.

Figure 3:
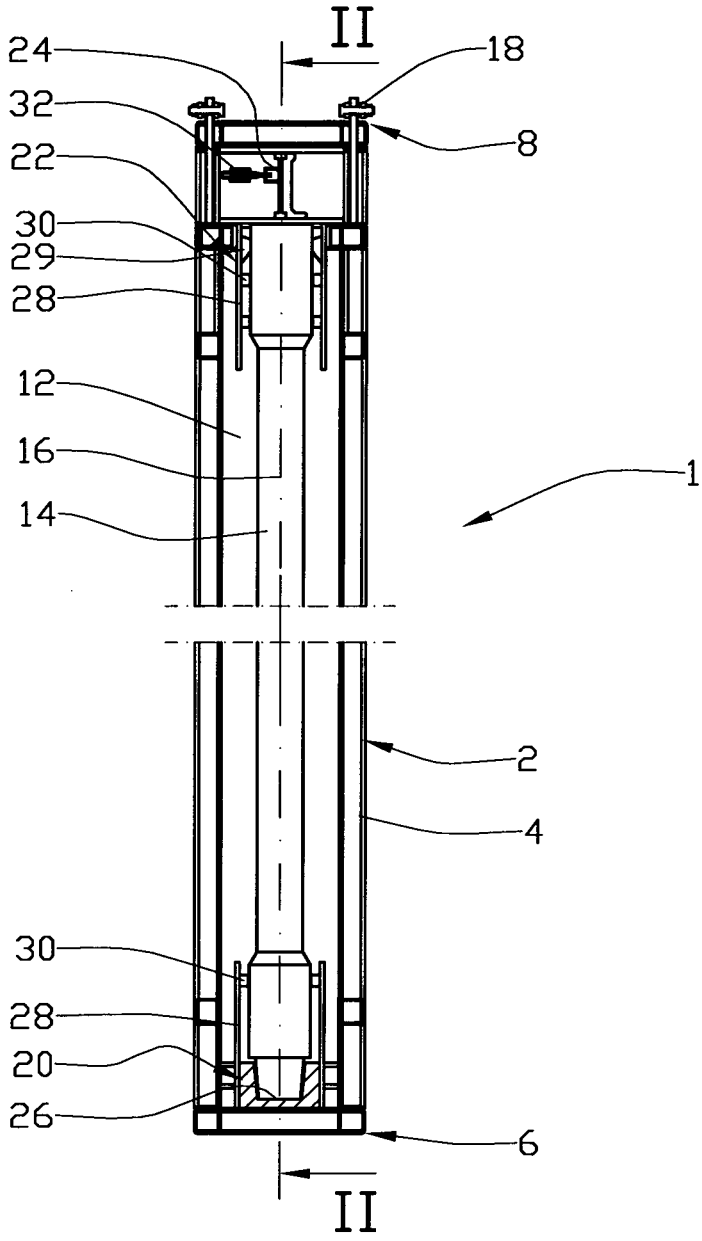
FIG. 3 shows a vertical section II-II of the pipe storage device of FIG. 2.

The stop 24, which is laterally movable, is kept in its active position by means of springs 32, see FIG. 3. By means of an actuator, a stop release or a handle, not shown, the stop 24 can be moved into a passive position, not shown, in which it is disengaged from the pipes 14.

The pipe storage device 1 shown is designed to hold five pipes 14. In the figures, four pipes 14 are shown.

During transport, the pipes 14 rest on each other while, at the same time, the stop 24 prevents the pipes 14 from moving out of the recesses 26 in the first pipe support 20.

When the pipe storage device 1 is arranged in its position of use in the drilling rig 10, the stop 24 is moved into its passive position.

Figure 4:
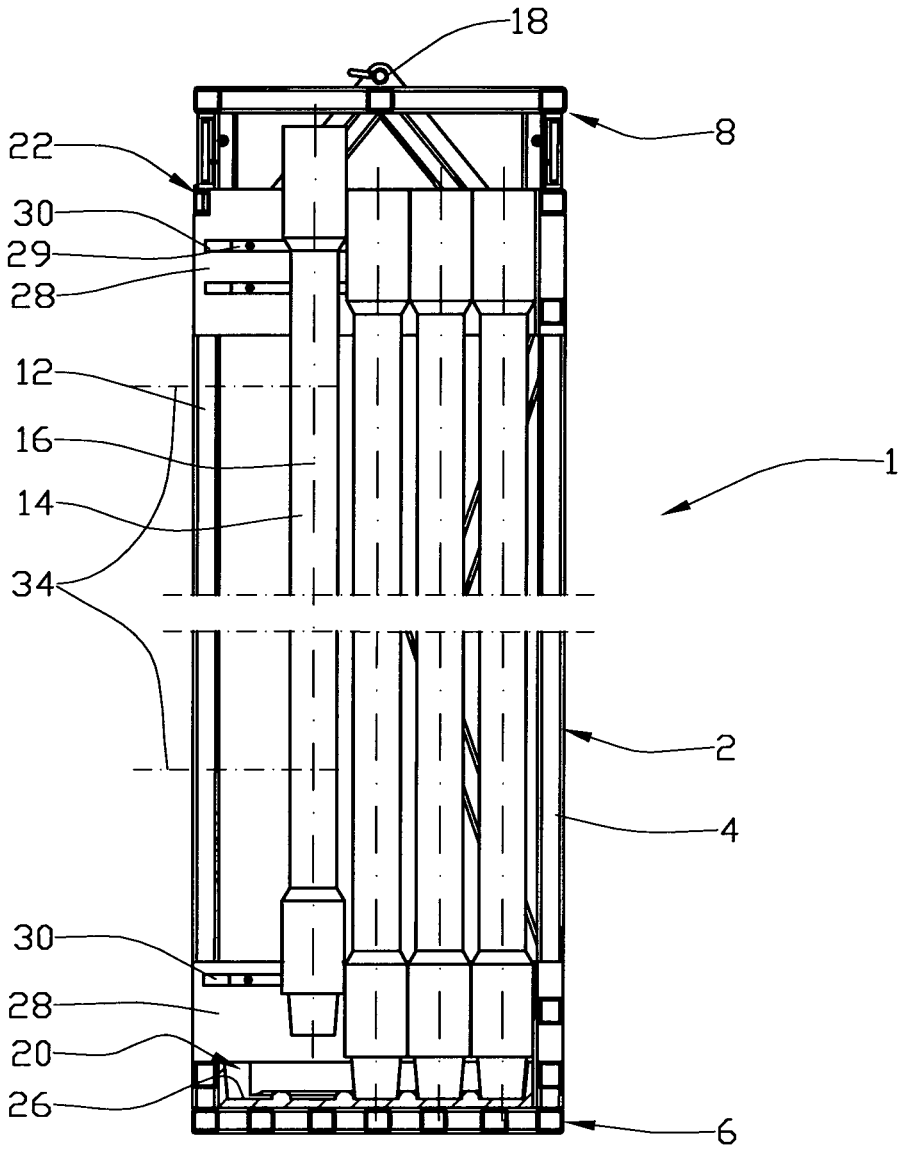
FIG. 4 shows the same as FIG. 2 but here, a pipe has been lifted inside the pipe storage device.
Figure 5:
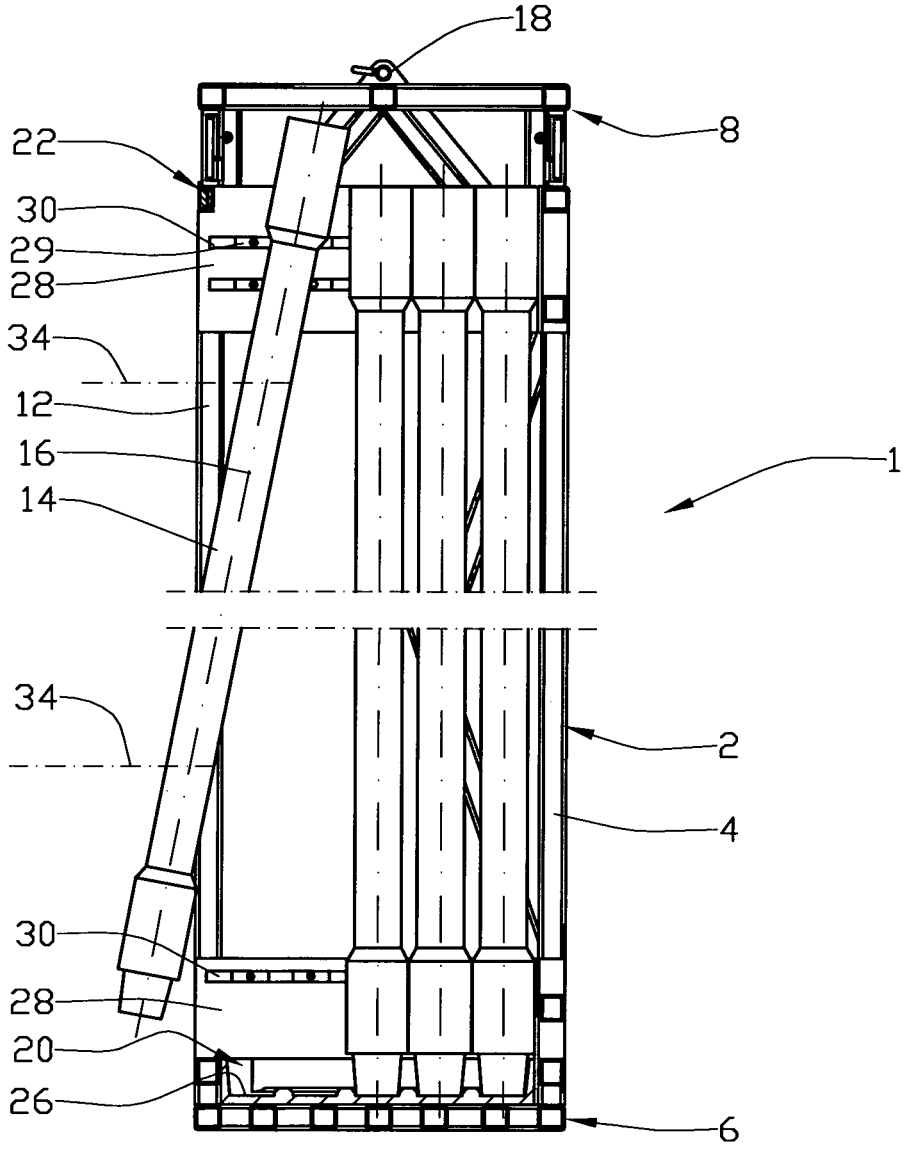
FIG. 5 shows the same as FIG. 4, but here, the lower portion of the pipe has been swung out of the pipe storage device.
Figure 6:
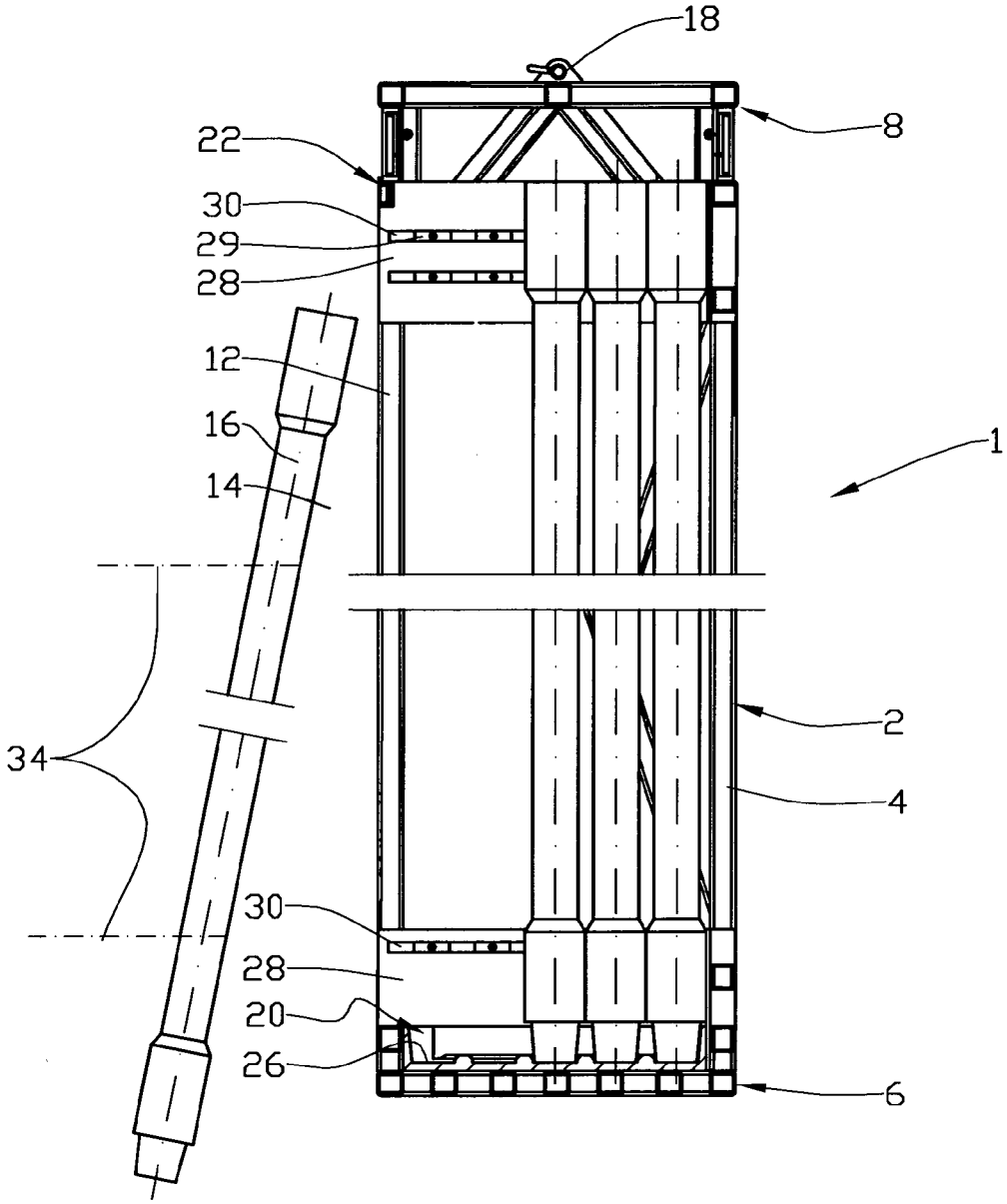
FIG. 6 shows the same as FIG. 5 but after the pipe has been lifted out of the pipe storage device.

When a pipe is to be removed from the pipe storage device 1, a pipe manipulator 34 of a design known per se is used, which is indicated in FIGS. 4-6 by means of the centre axes of the pipe manipulator grippers.

The pipe manipulator 34 is moved in through the opening 12 and grips the pipe 14. The pipe 14 is then lifted up from the recess 26, see FIG. 4. As the opening 12 is shorter than the length of the pipe 14, the pipe 14 is swung somewhat in the vertical plane, whereby the lower portion of the pipe 14 is moved out through the opening 12, see FIG. 5.

The pipe 14 is then lowered and moved out of the pipe storage device 1.

The method is repeated to remove the remaining pipes 14. The insertion of pipes 14 into the pipe storage device 1 is carried out in a corresponding manner, but in the reverse order.

The length of the opening 12, which is shorter than the length of the pipes 14, and the stop 24 prevent pipes from unintentionally being moved out of the pipe storage device 1.

The invention claimed is:

1. A portable pipe storage device for use in a drilling rig, wherein the pipe storage device is arranged to hold two or more pipes, the pipes which are stored in the pipe storage device having their longitudinal axes in a standing direction when the pipe storage device is in its position of use in the drilling rig, the pipe storage device comprising:

a frame structure with long sides and first and second end portions;

an opening in one of said long sides, the opening being arranged to constitute a displacement opening for the removal and insertion of pipes from/into the pipe storage device;

the first end portion forms a lower portion when the pipe storage device is in its position of use in the drilling rig;

the second end portion folios an upper portion when the pipe storage device is in its position of use; and non-yieldable bulbs provided at said second end portion, wherein the bulbs project in between the pipes and are arranged to prevent the pipes from unintentionally tilting sideways in the direction of insertion and removal.

2. The portable pipe storage device in accordance with claim 1, wherein the length of the opening is smaller than the length of the pipe.

3. The portable pipe storage device in accordance with claim 1, wherein the first end portion is provided with a first pipe support.

4. The portable pipe storage device in accordance with claim 1, wherein at the second end portion is provided with a second pipe support.

5. A portable pipe storage device for use in a drilling rig, wherein the pipe storage device is arranged to hold two or more pipes, the pipes which are stored in the pipe storage device having their longitudinal axes in a standing direction when the pipe storage device is in its position of use in the drilling rig, the pipe storage device comprising:

a frame structure with long sides and first and second end portions;

an opening in one of said long sides, the opening being arranged to constitute a displacement opening for the removal and insertion of pipes from/into the pipe storage device;

the first end portion forms a lower portion when the pipe storage device is in its position of use in the drilling rig;

the second end portion forms an upper portion when the pipe storage device is in its position of use;

bulbs provided at said second end portion, the bulbs project in between the pipes and which are arranged to prevent the pipes from unintentionally tilting sideways in the direction of insertion and removal; and wherein the pipe storage device is provided with a displaceable stop which is arranged to prevent pipes that are in the pipe storage device from being displaceable in an axial direction in the pipe storage device.

6. The portable pipe storage device in accordance with claim 5, wherein the stop is spring-loaded towards its active position.

* * * * *